US005759732A

United States Patent [19]

Nakamura et al.

[11] Patent Number: 5,759,732

[45] Date of Patent: Jun. 2, 1998

[54] TONER FOR DEVELOPING ELECTROSTATIC LATENT IMAGES WITH WAX PARTICLES OF SPHERICAL SHAPE AND OF SMALL SIZE UNIFORMLY DISPERSED IN BINDER RESIN

[75] Inventors: Akihiro Nakamura, Osaka; Hiroshi Nakamura, Kobe; Hideyuki Yoshida, Itami; Masami Eda, Kobe, all of Japan

[73] Assignee: Minolta Co., Ltd., Osaka, Japan

[21] Appl. No.: 655,342

[22] Filed: May 29, 1996

[30] Foreign Application Priority Data

May 30, 1995 [JP] Japan ..... 7-131665

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,355,088 | 10/1982 | Westdale et al. | 430/98 |
| 4,486,524 | 12/1984 | Fujisaki et al. | 430/109 |
| 4,578,338 | 3/1986 | Gruber et al. | 430/120 |
| 4,917,982 | 4/1990 | Tomono et al. | 430/99 |
| 4,946,755 | 8/1990 | Inoue | 430/106.6 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,176,978 | 1/1993 | Kumashiro et al. | 430/110 |
| 5,283,149 | 2/1994 | Tyagi et al. | 430/137 |
| 5,320,926 | 6/1994 | Ueda et al. | 430/110 |
| 5,424,162 | 6/1995 | Kohri et al. | 430/110 |
| 5,439,772 | 8/1995 | Takagi et al. | 430/106.6 |
| 5,486,445 | 1/1996 | Van Dusen et al. | 430/110 |

FOREIGN PATENT DOCUMENTS

| | | | |
|---|---|---|---|
| 1-217467 | 8/1989 | Japan | 430/110 |

OTHER PUBLICATIONS

Derwent English-Language Abstract of JP 1-217467 No. 89-295955/41 (1989).

Patent & Trademark Office English-Language Translation of JP 1-217467 (Pub. Aug. 1989).

*Primary Examiner*—Janis L. Dote

*Attorney, Agent, or Firm*—McDermott, Will & Emery

[57] ABSTRACT

A toner for developing electrostatic latent images is provided which contains wax particles of a spherical shape and of a small particle size uniformly distributed in binder resin.

20 Claims, 7 Drawing Sheets

TONER FOR DEVELOPING ELECTROSTATIC LATENT IMAGES WITH WAX PARTICLES OF SPHERICAL SHAPE AND OF SMALL SIZE UNIFORMLY DISPERSED IN BINDER RESIN

BACKGROUND OF THE INVENTION

1. Field of the Invention

The present invention relates to a toner for use in developing electrostatic latent images formed in processes such as electrophotography, electrostatic recording, and electrostatic printing. More particularly, the invention relates to a toner for developing electrostatic latent image which comprises at least binder resin and wax, the wax being distributed uniformly in the resin in the form of small particles having spherical shape and small particle size, and a method for manufacturing the toner.

2. Description of the Prior Art

A toner for developing electrostatic latent images is generally loaded with wax particles in order to prevent a so-called "offset" trouble such that when a toner image transferred to a copying sheet is fixed according to the hot-roll fixing technique, a part of the melted toner tends to transfer onto the fixing roller, which in turn is retransferred onto a next copying sheet.

A toner is obtained through the steps of mixing a wax, a binder resin, a colorant, and other desired additives (charge control agent, magnetic powder, or the like) together, melting and kneading the mixture, rolling the kneaded mixture, cooling the rolled mass, then pulverizing the same into particles, and classifying the particles. Since wax is poor in compatibility with the binder resin, melt wax particles are dispersed in melt binder resin in a dotting-island-like fashion during the process of melting and kneading. But, the wax particles, even once finely dispersed, are likely to recombine (re-aggregate) because they are low in viscosity. Therefore, the wax component is liable to considerable change in particle diameter and size under compressive force exerted when the kneaded mixture is discharged. As wax particles re-aggregate to grow larger, they become configured to have a rugby ball-like shape, and when the kneaded mixture is subjected to rolling and cooling, the wax particles therein undergo a further configurational change to a leaf-like shape.

Because of their low compatibility with the binder resin, wax particles are likely to be liberated during the pulverization of the kneaded mixture. Therefore, when a kneaded mixture containing wax particles of above mentioned rugby ball-like or leaf-like shape is pulverized, the inclusion of liberated wax particles in resulting toner particles does increase and, at the same time, liberated wax particles of a particle size similar to that of toner particles are likely to be included in the toner particles.

The inclusion of such liberated wax into a toner product may result in adherence of the liberated wax component to the photosensitive member to cause the trouble of filming, and may result in the formation of a black spot (BS) in the toner image, which may be a cause of degradation of quality of copied image.

Further, when rugby ball-like or leaf-like wax particles are mixed and present with the toner particles, the fluidity of the toner tends to be lowered to adversely affect the chargeability of the toner, the characteristics of toner supply for replenishment, and image quality.

Recently, as attempts are being made toward particle size reduction of toner for high precision image formation, toner particle size becomes smaller. The more is it necessary that wax particles be made smaller in particle size and be uniformly dispersed in the toner, the more remarkable will be the effect of liberated wax inclusion.

SUMMARY OF THE INVENTION

An object of the present invention is to provide a toner having wax particles of small particle size and of spherical configuration distributed uniformly in the toner.

It is another object of the invention to provide a method of manufacturing a toner having wax particles of small particle size and of spherical configuration distributed uniformly in the toner.

In accordance with the present invention there is provided toner comprising:

binder resin particles having a volume-mean particle size from 5 to 12 micro-meter;

colorant dispersed in the binder resin particles; and wax particles dispersed in the binder resin particles which have a particle size of 4 micro-meter or less and have a particle size distribution in which the wax particles having a particle size of 2 micro-meter or more are 5 number % or less and the wax particles having a particle size of 1 micro-meter or less are 75 number % or more, and 85 number % or more of the wax particles having a shape index SF from 100 to 160, said shape index SF being shown by the formula:

$$SF=100\pi R^2/4S$$

wherein S represents a size of a projection image of the wax particles and R represents the maximum length of the projection image of the wax particles.

DETAILED DESCRIPTION OF THE INVENTION

Figure 1:
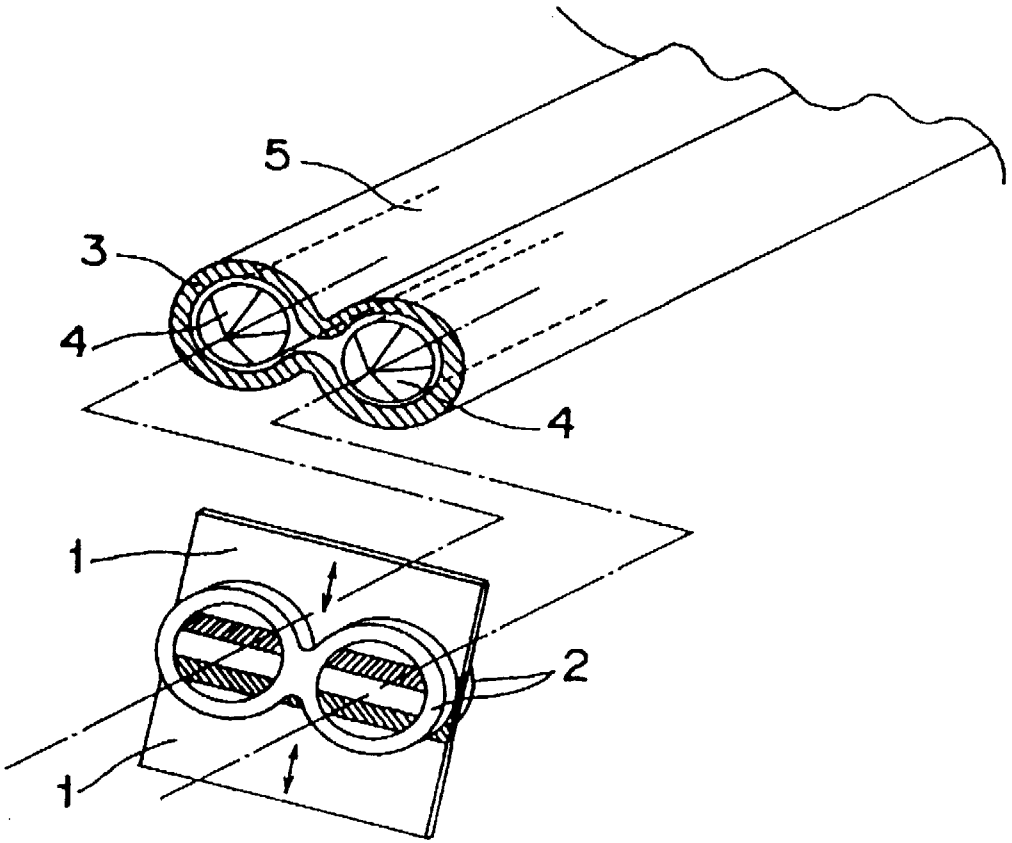
FIG. 1 is a schematic perspective view of an up-and-down movable cutter.

The toner for developing electrostatic latent images in accordance with the invention has a volume mean particle size of from 5 to 12 μm, preferably of from 5 to 9 μm. Such a small particle size toner is useful for formation of high precision images. If the particle size is smaller than 5 μm, it is difficult to manufacture the toner by the kneading and pulverizing process. If the particle size is larger than 12 μm, high image-quality is not obtainable. It is noted in this connection that the volume mean particle size of the toner is measured by a Coulter Multisizer (made by Coulter K.K.).

The wax particles dispersed in the toner of the present invention are not larger than 4 μm in particle size, and have a particle size distribution such that wax particles having a particle size of 2 μm or more are 5% or less, preferably from 0.1% to 5%; wax particles having a particle size of 1 μm or more but less than 2 μm are 5 to 15%; and wax particles having a particle size of less than 1 μm are 75% or more. Such a particle size distribution tells that wax particles of a small particle size are uniformly dispersed in toner particles, even where the toner particles are of a small particle size. Unless wax particles are distributed in the toner particles in such a fashion as described above, wax particles of a large particle size, and/or wax particles of a rugby ball shape or a leaf shape are present in the toner, the toner being thus subject to unfavorable effect of such wax particles. Preferably, wax particles dispersed in the toner are not larger than 4 μm in particle size and have a particle size distribution such that particles having a particle size of 2 μm or more are 4% or less; particles having a particle size of 1 μm or more but less than 2 μm are 6 to 13%; and particles having a particle size of less than 1 μm are 80 to 95%. More preferably, the wax particles dispersed in toner are not more than 3 μm in particle size and the particle size distribution thereof is such that particles having a particle size of 2 μm or more are 3% or less; particles having a particle size of 1 μm or more but less than 2 μm are 7 to 12%; and particles having a particle size of less than 1 μm are 85 to 95%.

Not less than 85%, preferably not less than 90%, of wax particles dispersed in the toner of the present invention are spherical in shape. The word "spherical", where used in the present invention, means that the wax particles have a shape index SF of 100 to 160, preferably 100 to 130, SF being represented by the formula:

$$SF=100\pi R^2/4S$$

in which S represents a size of a projection image of the wax particles and R represents the maximum length of the projection image of the wax particles.

The term "SF" value herein is a value expressing the difference between longer and shorter diameters of particles (degree of distortion). The SF value is equal to 100 if the particles are completely spherical.

If particles having an SF value within the above range are less than 85% in number, the toner may be undesirably subject to adverse effects of wax particles of rugby ball-like or leaf-like configuration.

In the present invention, the particle size distribution of wax particles and the SF value for the wax particles can be determined by the steps of dissolving the toner in chloroform, centrifuging the dissolved toner, collecting separated floating wax particles, electron-micrographing the collected wax particles, and image-processing the electron-micrograph obtained.

More specifically, a surface image of wax particles is input from a scanning electron micrograph to an image analyzer ("Luzex 5000"; made by Nippon Regulator K. K.) thereby to determine the particle size distribution and SF value. However, this does not mean that such a particular apparatus must be used in determining the particle size distribution and shape index SF, because there is no substantial difference in measurements even though any different apparatuses are used.

Where wax particles are not completely spherical, the particle size of the wax in the particle size distribution thereof is determined by measuring a maximum diameter of the particles, which is taken as the particle size of the wax.

Toners containing wax are conventionally made through the step of melting and kneading at least binder resin and wax. In the present invention, after a such melting and kneading operation, the kneaded mixture is continuously extruded so that the kneaded mixture, while being discharged, will not be subject to a pressure greater than the pressure applied thereon under the force of transport, whereby the toner of the invention can be obtained.

Figure 3:
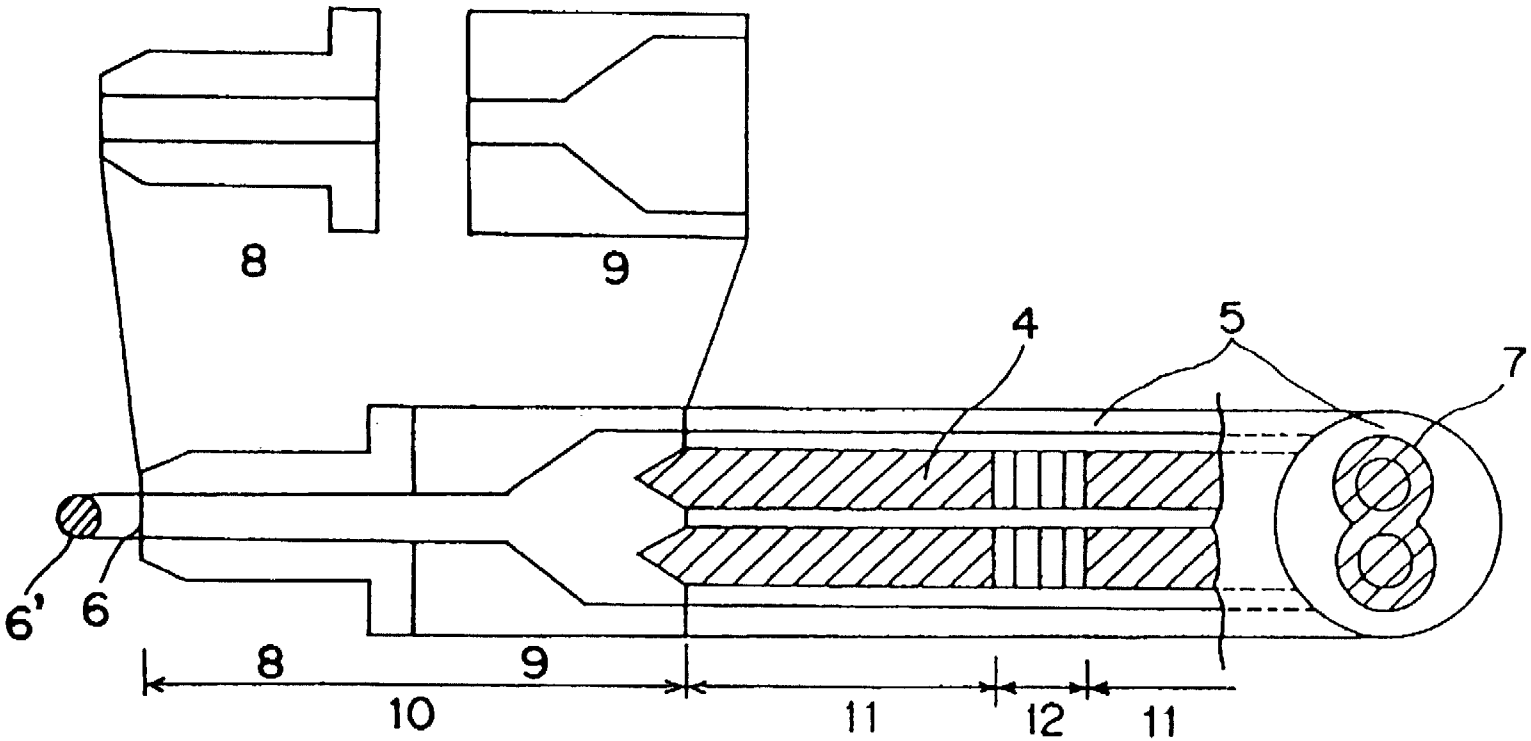
FIG. 3 is a partial schematic view of a conventional kneader-extruder machine.

For the melting and kneading operation in the production of toner, a kneader-extruder has conventionally been employed which has a discharge portion 10 composed of a nozzle portion 8 and a head portion 9 as shown in FIG. 3. FIG. 3 illustrates a twin screw type kneader-extruder. Raw material is supplied through a material inlet provided at one end of a heating cylinder 5, and is melted and kneaded in a conveying portion 11 and a kneading portion 12 through the rotation of a motor-driven paddle 4. The melted and kneaded material is conveyed along a conveying portion 11 and discharged from an outlet 6 of a discharge portion, and is introduced as it is into a press roll assembly, the press-rolled mass being then cooled and conveyed to a pulverizing process.

In such apparatus, the outlet 6 of the nozzle portion 8 of the discharge portion 10 is small, that is, a sectional area (a circular area shown by diagonal lines 6') of the outlet 6 is considerably smaller than a spatial sectional area 7 (a shaded area which embraces the paddle 4) of the cylinder 5. Therefore, the wax particles in the toner composition, though once uniformly dispersed as small-size particles during the melting and kneading process in the kneading portion 12 and conveying portion 11, tend to re-aggregate in the discharge portion 10 since they are subject to discharge pressure therein. This, in effect, not only prevents uniform dispersion of wax particles, but also causes the wax to lack uniformity in particle size and shape.

In order to improve the dispersibility of additives other than wax, such as a charge controlling agent and carbon black, through the use of such a conventional kneading process, it may be effective to increase the rotational speed of the screw. In that case, however, such a problem arises as greater discharge pressure will be applied to the kneaded material, resulting in degradation of the dispersibility of wax.

Even when it is desired to increase the quantity of wax addition in order to raise the upper temperature limit of toner offset, it is not easy to do so because such increase will adversely affect the dispersibility of wax particles.

Such problems as above can be solved by carrying out a kneading and extruding process in such a manner that the kneaded mass, when it is discharged, will not be subject to pressure greater than the pressure applied to the kneaded mass due to transportation thereof after melting and kneading operation. Specifically, a kneader-extruder which has no nozzle portion and no head portion is employed to carry out the melting and kneading of a mixture of toner binder resin, wax and other additives and the kneaded mass is discharged.

For the binder resin, any conventionally used thermoplastic resin, such as styrene-acrylic copolymer resin or polyester resin, may be used.

For the wax ingredient, paraffinic waxes are preferably used including, for example, low-molecular-weight polypropylene, low-molecular-weight polyethylene, ethylene-bis-amide, microcrystalline wax, carnauba wax, and beeswax. These waxes are normally incompatible with any thermoplastic resin used as a binder resin for toner and are capable of becoming liberated. The quantity of addition of such wax is 1 to 9 parts by weight, preferably 2 to 8 parts by weight, relative to 100 parts by weight of binder resin. If the quantity of wax addition is less than 1 part by weight, the anti-offset effect of the wax is insufficient. If the quantity of wax addition is more than 9 parts by weight, the trouble of filming or the like is likely to occur. According to the present invention, even where a toner is loaded with a relatively large proportion of wax, for example, 5 to 9 parts by weight, preferably 5 to 8 parts by weight, the toner can be advantageously used without any filming or black spot being caused.

Figure 2:
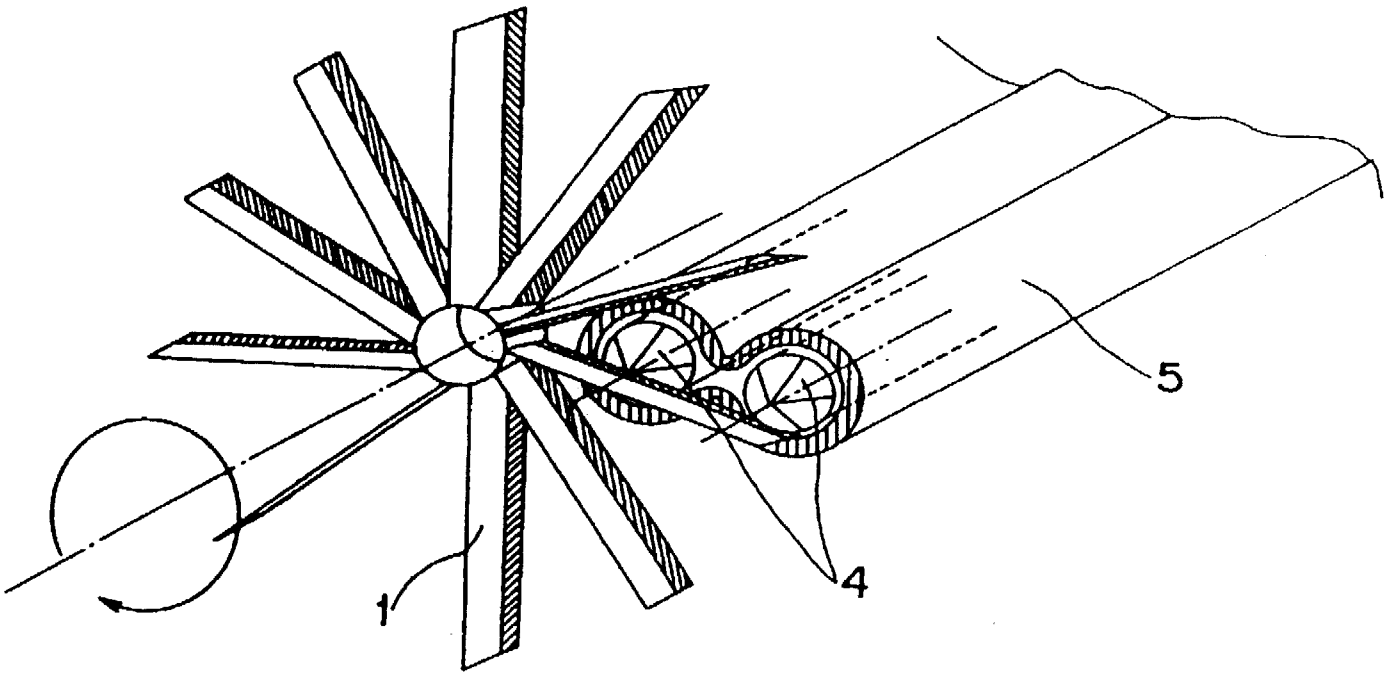
FIG. 2 is a schematic perspective view of a rotary cutter.

In the present invention, nozzle and head portions are removed from a kneader-extruder of the conventional type and one of cutting devices as shown in FIGS. 1 and 2 are mounted in their place; and by using such arrangement, continuous kneading operation is carried out with respect to toner compositions. Cutting devices useful for the purpose of the present invention are not particularly limited to those mentioned above. It is only required that the device should be capable of continuously processing sequentially discharged lots of kneaded material to suitable lengths and should involve no inconvenience for supply of processed lots to the subsequent pulverizing stage.

FIG. 1 illustrates an up-and-down movable cutter 1 which sequentially cuts kneaded material as the kneaded material is discharged from a center hole of a cutter mount 2 through the rotation of a paddle 4, such cutting operation being carried out through up-and-down movement of the cutter 1. The cutter 1 may be operated either manually or automatically. The cutter mount 2 is mounted to a front end portion 3 of the conventional kneader-extruder from which the discharge portion 10 composed of the nozzle portion 8 and the head portion 9 has been removed.

Shown in FIG. 2 is a rotary cutter which cuts kneaded material sequentially as the kneaded material is discharged through the rotation of the paddle 4, the cutting operation being effected through rotary movement of the cutter 1. The cutter 1 may be operated either manually or automatically.

In this way, by removing the discharge portion (nozzle portion and head portion) for the conventional kneader-extruder to thereby arrange so that any discharge pressure will not be applied on kneaded material during discharge thereof, it is possible to carry out continuous and efficient production of a kneaded product in which spherical wax particles of a small particle size are uniformly dispersed.

Where such a method is used, even if the rotational speed of the paddle of the kneader is increased for kneading operation, there will occur no re-coalescence of wax particles; and any re-coalescence of wax particles will not occur even if the amount of wax addition is increased in carrying out kneading operation.

The kneaded material thus obtained is pulverized and classified. The resulting toner involves less liberated wax, is less likely to incur black spots and filming, and is capable of high quality image formation.

The following examples are given to further illustrate the present invention.

EXAMPLES

Example 1

| | |
|---|---|
| Thermoplastic styrene-acrylic resin (Mn: 5,800, Mw/Mn: 48) | 100 parts by weight |
| Carbon black (MA#8; by Mitsubishi Kagaku Kogyo K. K.) | 7 parts by weight |
| Nigrosine dye (Nigrosine Base EX; by Orient Kagaku Kogyo K. K.) | 3 parts by weight |

-continued

| | |
|---|---|
| Low-molecular-weight polypropylene ("Biscol" 660P; by Sanyo Kasei Kogyo K.K.) | 6 parts by weight |

These materials were mixed and ground in a ball mill (made by Nihon Tokusyu Tougyo K.K.) for 13 hours. Then, by using a kneading apparatus which is similar to a conventional kneader-extruder (PCM-30; made by Ikegai Tekkou K.K.) except that the discharge portion thereof is removed and that a vertically movable cutter as shown in FIG. 1 is mounted in place, the ground mixture was melted and kneaded under the conditions of: set temperature, 125° C., paddle rotation speed, 100 rpm, and feed rate, 5 kg/hr. As a result, a kneaded product cut to lengths of about 1 cm each was obtained.

The kneaded product was sufficiently cooled by being exposed to a strong current of cool air (temperature: 5° C.; total air flow: 1 $m^3$/min.), and was then roughly ground, finely pulverized, and classified. Thus, particles having a volume mean particle size of 11.2μm were obtained.

The particles were mixed with 0.2 wt % of hydrophobic silica (H-2000; made by Hoechst Co.) for surface treatment to give toner A.

Example 2

Particles having a volume mean particle size of 11.4 μm were obtained in the same way as in EXAMPLE 1, except that 2 parts by weight of the low-molecular-weight polypropylene was used.

The particles were mixed with 0.2 wt % of hydrophobic silica (H-2000; made by Hoechst Co.) for surface treatment to give toner B.

Example 3

Figure 4:
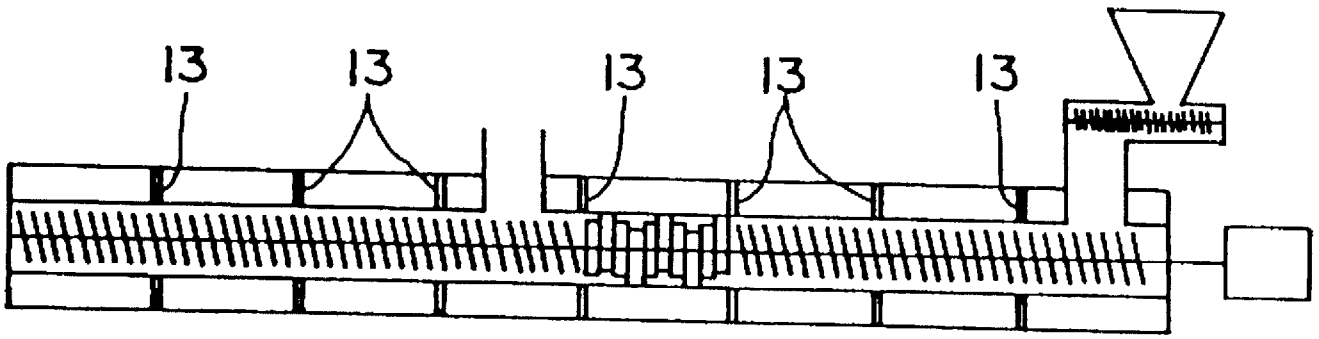
FIG. 4 is a schematic view showing a kneader-extruder having a cylinder which is internally partitioned with a heat insulating material into seven parts.

Particles having a volume mean particle size of 11.4 μm were obtained in the same way as in EXAMPLE 1, except that a kneader-extruder was employed such that a cylinder within the kneader-extruder was partitioned into seven parts by heat insulating material 13 as shown in FIG. 4, and except that the temperature of only a cylinder located most adjacent to the outlet port from which kneaded material is discharged was set to 100° C.

The particles were mixed with 0.2 wt % of hydrophobic silica (H-2000; made by Hoechst Co.) for surface treatment to give toner C.

Example 4

Particles having a volume mean particle size of 11.3 μm were obtained in the same way as in EXAMPLE 1, except that a rotary cutter as shown in FIG. 2 was used as a cutting device.

The particles were mixed with 0.2 wt % of hydrophobic silica (H-2000; made by Hoechst Co.) for surface treatment to give toner D.

Example 5

Particles having a volume mean particle size of 11.2 μm were obtained in the same way as in EXAMPLE 3, except that kneaded material was drawn by a cooling press roller to a thickness of 1.1 mm and was then placed on a cooling belt to be cooled to a sufficient degree.

The particles were mixed with 0.2 wt % of hydrophobic silica (H-2000; made by Hoechst Co.) for surface treatment to give toner E.

Example 6

Particles having a volume mean particle size of 11.5 μm were obtained in the same way as in EXAMPLE 3, except that paddle rotational speed was set at 250 rpm and feed rate at 8 kgs/hr.

The particles were mixed with 0.2 wt % of hydrophobic silica (H-2000; made by Hoechst Co.) for surface treatment to give toner F.

Example 7

Particles having a volume mean particle size of 11.3 μm were obtained in the same way as in EXAMPLE 1, except that the following materials were used:

| | |
|---|---|
| Polyester resin | 100 parts by weight |
| Carbon black (MA#8; by Mitsubishi Kagaku Kogyo K. K.) | 7 parts by weight |
| Cr metal containing oil-soluble dye ("Spiron Black TRH"; by Hodogaya Kagaku K.K.) | 3 parts by weight |
| Low-molecular-weight polypropylene ("TS 200"; by Sanyo Kasei Kogyo K.K.) | 6 parts by weight |

The particles were mixed with 0.2 wt % of hydrophobic silica (H-2000; made by Hoechst Co.) for surface treatment to give toner G.

Comparative Example 1

Particles having a volume mean particle size of 11.4 μm were obtained in the same way as in EXAMPLE 1, except that a conventional kneader-extruder having a nozzle portion and a head portion as shown in FIG. 3 was employed for kneading and extruding operations.

The particles were mixed with 0.2 wt % of hydrophobic silica (H-2000; made by Hoechst Co.) for surface treatment to give toner H.

Comparative Example 2

Particles having a volume mean particle size of 11.3 μm were obtained in the same way as in COMPARATIVE EXAMPLE 1, except that 2 parts of the low-molecular-weight polypropylene was used.

The particles were mixed with 0.2 wt % of hydrophobic silica (H-2000; made by Hoechst Co.) for surface treatment to give toner I.

Comparative Example 3

Particles having a volume mean particle size of 11.4 μm were obtained in the same way as in EXAMPLE 5, except that a conventional kneader-extruder having a nozzle portion and a head portion as shown in FIG. 3 was employed for kneading and extruding operations.

The particles were mixed with 0.2 wt % of hydrophobic silica (H-2000; made by Hoechst Co.) for surface treatment to give toner J.

Comparative Example 4

Particles having a volume mean particle size of 11.3 μm were obtained in the same way as in EXAMPLE 6, except that a conventional kneader-extruder having a nozzle portion and a head portion as shown in FIG. 3 was employed for kneading and extruding operations.

The particles were mixed with 0.2 wt % of hydrophobic silica (H-2000; made by Hoechst Co.) for surface treatment to give toner K.

Comparative Example 5

Particles having a volume mean particle size of 11.2 μm were obtained in the same way as in COMPARATIVE EXAMPLE 1, except that the materials used in EXAMPLE 7 were used.

The particles were mixed with 0.2 wt % of hydrophobic silica (H-2000; made by Hoechst Co.) for surface treatment to give toner L.

With respect to each of the toners A to L obtained in the foregoing examples and comparative examples, maximal particle size, percentage of wax particles having a shape meeting the relation $100 \leqq SF \leqq 160$, and particle size distribution of wax particles were examined by the following method.

Each of these toners A to L was dissolved in chloroform and the solution was centrifugalized. Floating wax particles were collected and the collected particles were electron-micrographed. The micrograph was image-processed and data were obtained for aforesaid examination items. The results are shown in Table 1.

TABLE 1

| Example/ Comparative Example | Type of Toner | Max. wax particle size (μm) | $100 \leqq SF \leqq 160$ (number %) | Wax Particle size distribution: Less than 1 μm (number %) | 1 μm or more but less than 2 μm (number %) | 2 μm or more but less than 5 μm (number %) | 5 μm or more but less than 15 μm (number %) | 15 μm or more (number %) |
|---|---|---|---|---|---|---|---|---|
| EXAMPLE 1 | A | 2.7 | 90 | 90.0 | 9.0 | 1.0 | 0.0 | 0.0 |
| EXAMPLE 2 | B | 2.5 | 94 | 92.0 | 7.0 | 1.0 | 0.0 | 0.0 |
| EXAMPLE 3 | C | 2.5 | 92 | 91.0 | 8.0 | 1.0 | 0.0 | 0.0 |
| EXAMPLE 4 | D | 2.9 | 89 | 89.0 | 10.0 | 1.0 | 0.0 | 0.0 |
| EXAMPLE 5 | E | 3.8 | 86 | 81.0 | 14.0 | 5.0 | 0.0 | 0.0 |
| EXAMPLE 6 | F | 3.0 | 89 | 86.0 | 12.0 | 2.0 | 0.0 | 0.0 |
| EXAMPLE 7 | G | 2.3 | 90 | 92.0 | 7.0 | 1.0 | 0.0 | 0.0 |
| COMPARATIVE EXAMPLE 1 | H | 12.1 | 50 | 64.0 | 22.0 | 12.3 | 1.7 | 0.0 |
| COMPARATIVE EXAMPLE 2 | I | 7.3 | 75 | 76.0 | 15.5 | 7.5 | 1.0 | 0.0 |
| COMPARATIVE EXAMPLE 3 | J | 20.0 | 25 | 34.0 | 33.0 | 25.8 | 7.0 | 0.2 |
| COMPARATIVE EXAMPLE 4 | K | 16.3 | 45 | 48.0 | 30.0 | 18.0 | 4.0 | 0.0 |

TABLE 1-continued

| Example/ Comparative Example | Type of Toner | Max. wax particle size (μm) | 100 ≦ SF ≦ 160 (number %) | Wax Particle size distribution: Less than 1 μm (number %) | 1 μm or more but less than 2 μm (number %) | 2 μm or more but less than 5 μm (number %) | 5 μm or more but less than 15 μm (number %) | 15 μm or more (number %) |
|---|---|---|---|---|---|---|---|---|
| COMPARATIVE EXAMPLE 5 | L | 11.5 | 55 | 61.0 | 24.0 | 13.0 | 2.0 | 0.0 |

Figure 5:
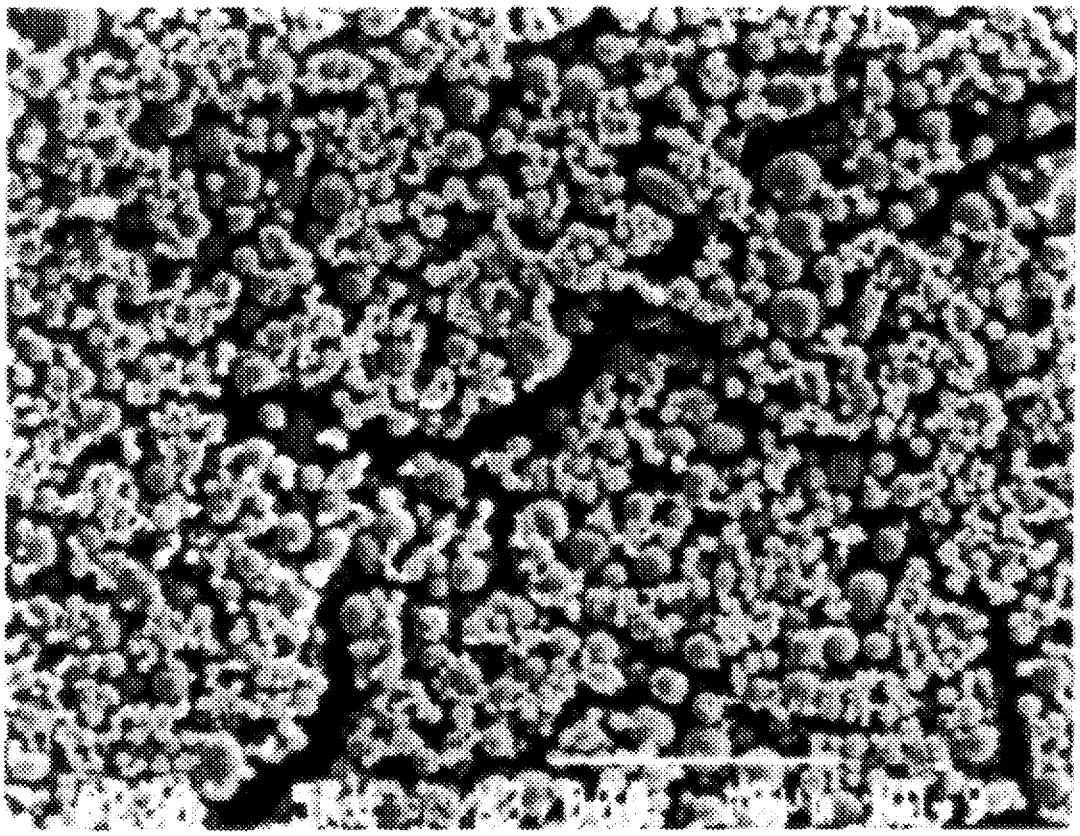
FIG. 5 is an electron microscope photograph (SEM photograph) of wax particles contained in a toner obtained in EXAMPLE 1.
Figure 6:
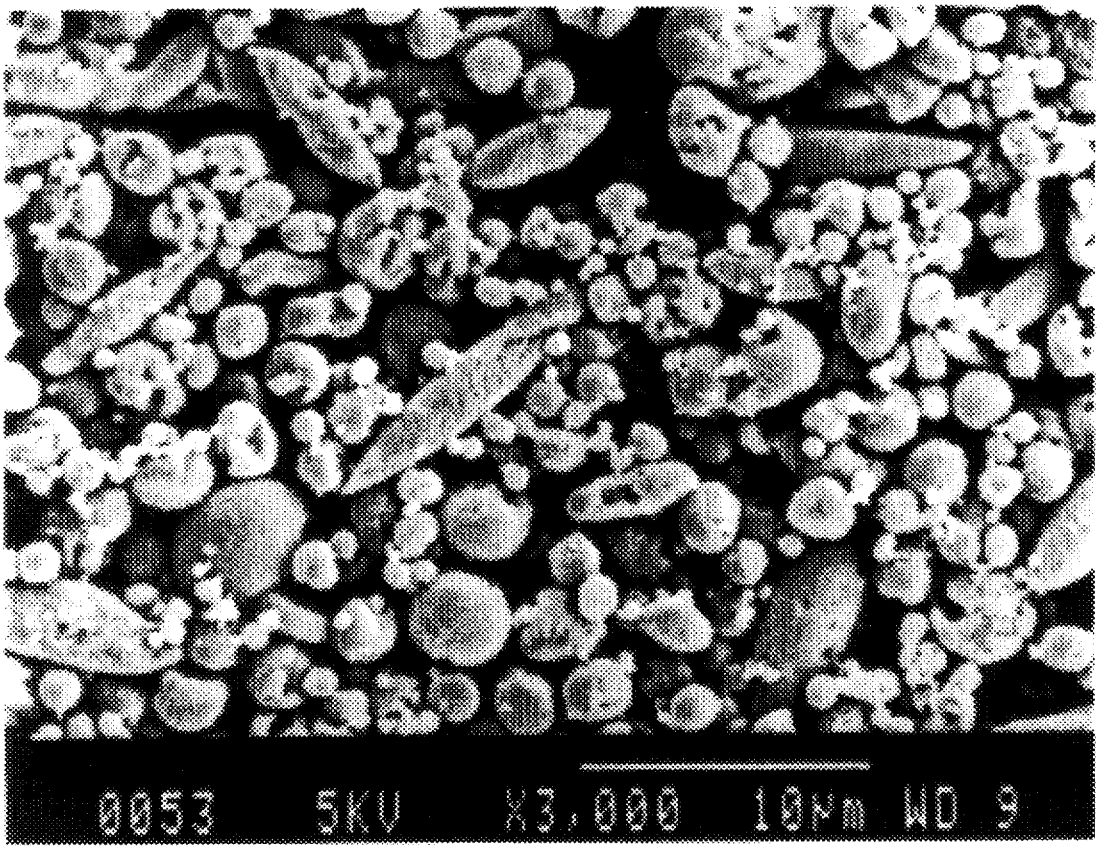
FIG. 6 is an electron microscope photograph (SEM photograph) of wax particles contained in a toner obtained in COMPARATIVE EXAMPLE 1.
Figure 7:
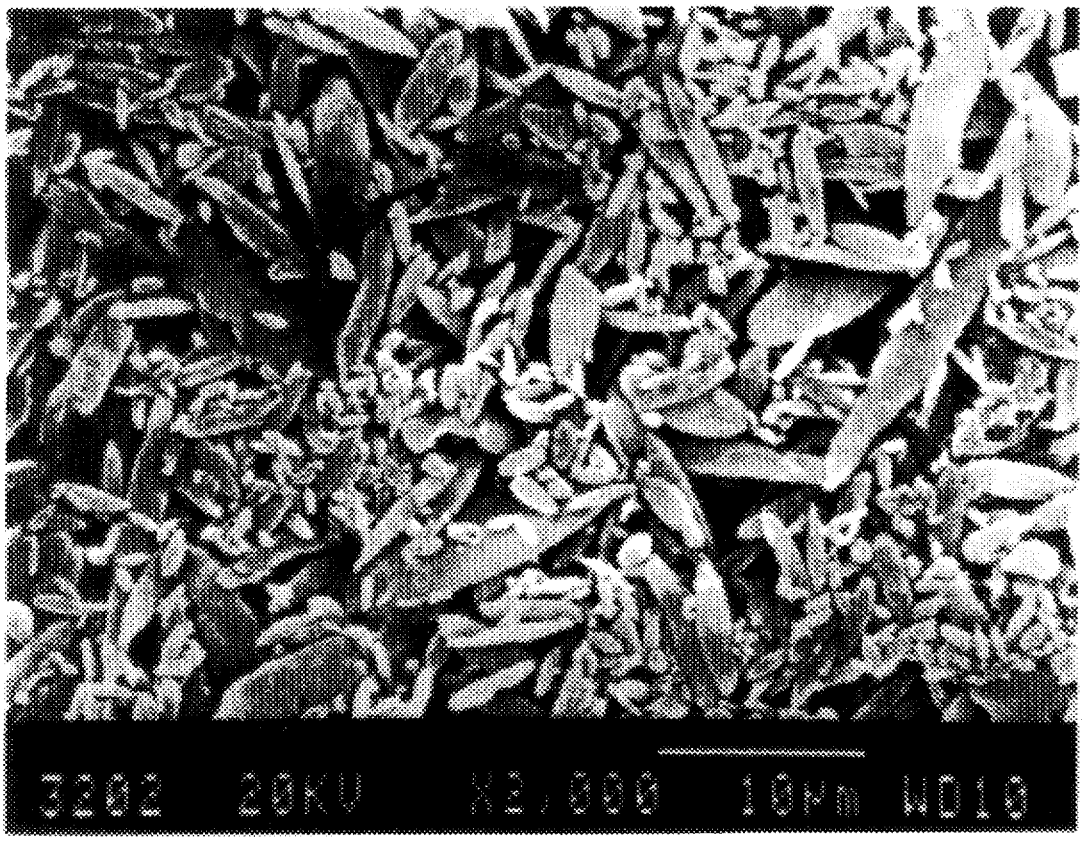
FIG. 7 is an electron microscope photograph (SEM photograph) of wax particles contained in a toner obtained in COMPARATIVE EXAMPLE 3.

With respect to toners A, H and J, electro-micrographs of wax particles are shown in FIGS. 5 to 7. In FIG. 5 for toner A, spherical wax particles of a minute particle size are shown as being present in the toner. In FIG. 6 for toner H, rugby ball-shaped wax partiparticles including those having a major axis longer than 10 μm are shown as being present in the toner. In FIG. 7 for toner J, leaf-shaped wax particles including those having a major axis longer than 15 μm are shown as being present in the toner.

Evaluation

Durability test with respect to copy was carried out with respect to toners obtained in the foregoing examples and comparative examples to examine the presence of any filming defects and black spots (BS).

Each of the toners other than toner G and toner L was sufficiently mixed with a separately prepared binder-type carrier (having a mean particle size of 65 μm) to be electrically charged. Copying was carried out using each such toner on a copying machine (EP8600; made by Minolta K.K.), with its photosensitive member replaced with an organic photosensitive member, through intermittent copying operation of 6 copies each to a total of 30,000 copies. Other conditions (charging, transfer, developing bias, etc.) were adjusted depending on toners. Toners G and L were used as they were; and copying was carried out by a copying machine (EP8600; made by Minolta K.K.) through intermittent copying operation of 6 copies each to a total of 30,000 copies.

In these copying operations, evaluation was made with respect to filming and BS aspects observed after copying of the 10,000th copy and of the 30,000th copy.

For filming, the condition of filming on the photosensitive member was evaluated. Where no filming was observed, the toner was ranked as "•"; where a slight degree of filming was observed, ranking was "O"; where filming occurred with the result that fogging was locally observed, the toner was ranked as "Δ"; and where filming occurred, resulting in decrease in the sensitivity of the photosensitive member, and where fogging was observed, the toner was ranked as "x". Toner ranked as "O" or higher was taken as a toner involving no problem for practical use.

For evaluation as to BS, where no trace of BS was observed on the photosensitive member, the toner was ranked as "O"; where some black spots were observed on the photosensitive member, but no black spot was observed in copied images, the toner was ranked as "Δ"; and where some black spots were observed in copied images, the toner was ranked as "x". Toner ranked as "Δ" or higher was taken as a toner involving no problem for practical use.

Evaluation results are shown in Table 2.

TABLE 2

| Example/ Comparative Example | Type of Toner | After 10,000th copying: Filming | After 10,000th copying: BS | After 30,000th copying: Filming | After 30,000th copying: BS |
|---|---|---|---|---|---|
| EXAMPLE 1 | A | ◎ | ○ | ◎ | ○ |
| EXAMPLE 2 | B | ◎ | ○ | ◎ | ○ |
| EXAMPLE 3 | C | ◎ | ○ | ◎ | ○ |
| EXAMPLE 4 | D | ◎ | ○ | ◎ | ○ |
| EXAMPLE 5 | E | ◎ | ○ | ○ | ○ |
| EXAMPLE 6 | F | ◎ | ○ | ◎ | ○ |
| EXAMPLE 7 | G | ◎ | ○ | ◎ | ○ |
| COMPARATIVE EXAMPLE 1 | H | ○ | Δ | Δ | X |
| COMPARATIVE EXAMPLE 2 | I | ○ | Δ | Δ | Δ |
| COMPARATIVE EXAMPLE 3 | J | X | X | X | X |
| COMPARATIVE EXAMPLE 4 | K | Δ | Δ | X | X |
| COMPARATIVE EXAMPLE 5 | L | ○ | Δ | Δ | X |

The foregoing results tell that by using a kneading unit which corresponds to a conventional type kneader-extruder or such a kneader-extruder having an internal cylinder partitioned by heat insulating material into seven parts, with its nozzle and head portions removed therefrom, as in EXAMPLES 1 to 7, it is possible to obtain a toner containing spherical wax particles of a minute particle size uniformly dispersed therein, which is capable of forming satisfactory copy images free of filming and BS.

In COMPARATIVE EXAMPLES 1 to 5 wherein a conventional kneader-extruder having a nozzle portion and a head portion was employed, a toner containing spherical wax particles of a minute particle size uniformly dispersed therein could not be obtained, and the resulting toner suffered from filming and BS occurrences and was unable to provide any satisfactory copy image.

EXAMPLES 1 and 6, and COMPARATIVE EXAMPLE 4 tell that even where paddle rotational speed is increased, and where feed rate is increased, the use of a kneader unit having no nozzle portion and no head portion makes it possible to obtain a toner containing spherical wax particles of a minute particle size without any wax coalescence being caused.

With respect to toners A, H and J, loosening apparent specific gravity measurements were made for fluidity evaluation. The results are shown in Table 3. Evaluation of toner fluidity was made on the basis of the loosening apparent specific gravity of the toner as measured by a powder tester (made by Hosokawa Micron K.K.), and in such a way that a toner having a loosening apparent specific gravity of 0.40 or more was ranked as "O"; a toner having such a specific gravity of 0.35 or more but less than 0.40 was ranked as "Δ";

and a toner having a loosening apparent specific gravity of less than 0.35 was ranked as "x".

TABLE 3

| Example/ Comparative Example | Type of Toner | Loosening apparent specific gravity (g/cc) | Fluidity |
|---|---|---|---|
| EXAMPLE 1 | A | 0.443 | ○ |
| COMPARATIVE EXAMPLE 1 | H | 0.385 | Δ |
| COMPARATIVE EXAMPLE 3 | J | 0.344 | X |

In COMPARATIVE EXAMPLES 1 and 3, loosening apparent specific gravity is lower than that in EXAMPLE 1. Judging from FIGS. 6 to 8, this may be due to the fact that wax particles in the toner obtained have a rugby ball-like or leaf-like configuration. It is thus considered that such low loosening apparent specific gravity has relation to the aspect of low fluidity.

Further, in order to examine the relationship between offset-occurring temperature and quantity of wax addition, offset-occurring temperatures were examined with respect to toners A, B and I. The results are shown in Table 4.

TABLE 4

| Example/ Comparative Example | Type of Toner | Offset occurring temperature (°C.) |
|---|---|---|
| EXAMPLE 1 | A | 250° C. or more |
| EXAMPLE 2 | B | 230 |
| COMPARATIVE EXAMPLE 2 | I | 200 |

A comparison between COMPARATIVE EXAMPLE 2 and EXAMPLES 2 and 3 tells that as the quantity of wax addition is larger, offset-occurring temperature is higher. While the quantity of wax addition is same, the offset-occurring temperature in the case of the toner of the present invention is considerably higher than that in the case of the toner prepared through kneading operation using the conventional apparatus. The reason for this may be that wax particles of fine particle size are more uniformly dispersed in the toner of the invention.

The toner in accordance with the present invention contains spherical wax particles of minute particle size uniformly dispersed therein and involves no possibility of filming on the photosensitive member due to wax liberation and any resultant black spot occurrence. Where the paddle rotational speed is increased to raise the feed rate, there will occur no re-coalescence of wax particles, it being thus possible to obtain a toner which can provide satisfactory copy-image formation.

What is claimed is:

1. Toner comprising: binder resin, colorant and wax particles dispersed in the binder resin;

said toner having a volume-mean particle size from 5 to 12 micro-meter;

wherein said wax particles included in the toner are not larger than 4 micro-meter in particle size and have a particle size distribution in which the wax particles having a particle size of 2 micro-meter or more are 5% in number or less, the wax particles having a particle size ranging from 1 micro-meter to less than 2 micro-meter are 5% to 15% in number and the wax particles having a particle size of 1 micro-meter or less are 75% in number or more, and 85% in number or more of the wax particles having a shape index SF from 100 to 160, said shape index SF being shown by the formula:

$$SF=100\pi R^2/4S$$

wherein S represents a size of a projection image of the wax particles and R represents the maximum length of the projection image of the wax particles.

2. The toner of claim 1, wherein the wax particles have the particle size distribution in which the wax particles having the particle size ranging from 1 micro-meter to less than 2 micro-meter are 6% to 13% in number.

3. The toner of claim 2, wherein the wax particles have the particle size distribution in which the wax particles having the particle size ranging from 1 micro-meter to less than 2 micro-meter are 7% to 12% in number.

4. The toner of claim 1, wherein the wax particles have the particle size distribution in which the wax particles having the particle size ranging from 1 micro-meter to less than 2 micro-meter are from 6% to 13% in number, the wax particles having the particle size of 2 micro-meter or more are 4% in number or less, and the wax particles having the particle size of 1 micro-meter or less are from 85 to 95%.

5. The toner of claim 4, wherein the wax particles have the particle size distribution in which the wax particles having the particle size ranging from 1 micro-meter to less than 2 micro-meter are from 7% to 12% in number, the wax particles having the particle size of 2 micro-meter or more are 3% in number or less, and the wax particles having the particle size of 1 micro-meter or less are from 85 to 95% in number.

6. The toner of claim 1, wherein the wax particles have a particle size distribution in which the wax particles having a particle size of 2 micro-meter or more is from 0.1% to 5% in number.

7. The toner of claim 5, wherein the wax particles have a particle size of 3 micro-meter or less.

8. The toner of claim 5, wherein 90% number or more of the wax particles have the shape index SF from 100 to 160.

9. The toner of claim 1, wherein the shape index SF is from 100 to 130.

10. The toner of claim 1, wherein the weight ratio of the wax particles to the binder resin is from 1:100 to 9:100 by weight.

11. The toner of claim 1, wherein the volume-mean particle size is from 5 to 9 micro-meter.

12. Toner comprising:

binder resin, colorant and wax particles dispersed in the binder resin;

said toner having a volume-mean particle size from 5 to 12 micro-meter;

wherein said wax particles included in the toner are not larger than 4 micro-meter in particle size and have a particle size distribution in which the wax particles having a particle size of 2 micro-meter or more are 5% in number or less, the wax particles having a particle size ranging from 1 micro-meter to less than 2 micro-meter are from 5% to 15% in number and the wax particles having a particle size of 1 micro-meter or less are 75% in number or more.

13. The toner of claim 12, wherein the wax particles have the particle size distribution in which the wax particles having the particle size ranging from 1 micro-meter to less than 2 micro-meter are 6% to 13% in number.

14. The toner of claim 12, wherein the wax particles have the particle size distribution in which the wax particles having the particle size of 2 micro-meter or more are 4% in number or less, the wax particles having the particle size ranging from 1 micro-meter to less than 2 micro-meter are from 6 to 13% in number, and the wax particles having the particle size of 1 micro-meter or less are 85 to 95% in number.

15. The toner of claim 12, wherein the wax particles have the particle size distribution in which the wax particles having the particle size of 2 micro-meter or more are 3% in number or less, the wax particles having the particle size ranging from 1 micro-meter to less than 2 micro-meter are from 7 to 12% in number, and the wax particles having the particle size of 1 micro-meter or less are 85 to 95% in number.

16. The toner of claim 12, wherein 85 number % in or more of the wax particles have a shape index SF from 100 to 160, the shape index being shown by the following formula:

$$SF=100\pi R^2/4S$$

wherein S represents a size of a projection image of the wax particles and R represents the maximum length of the projection image of the wax particles.

17. The toner of claim 16, wherein 90% number or more of the wax particles have the shape index SF from 100 to 160.

18. The toner of claim 17, wherein the shape index SF is from 100 to 130.

19. The toner of claim 12, wherein the weight ratio of the wax particles to the binder resin is from 1 to 9 parts by weight to 100 parts by weight.

20. The toner of claim 12, wherein the volume-mean particle size is from 5 to 9 micro-meter.

* * * * *

UNITED STATES PATENT AND TRADEMARK OFFICE

CERTIFICATE OF CORRECTION

PATENT NO. : 5,759,732

DATED : June 2, 1998

INVENTOR(S) : NAKAMURA et al.

It is certified that error appears in the above-identified patent and that said Letters Patent is hereby corrected as shown below:

Col. 12, line 24: After "95%" insert --in number--

Col. 12, line 39: After "90%" insert --in--

Col. 13, line 15: Change "number % in" to --% in number--

Col. 14, line 6: After "90%" insert --in--

Signed and Sealed this

Twentieth Day of October, 1998

Bruce Lehman

*Attest:*

BRUCE LEHMAN

*Attesting Officer*

*Commissioner of Patents and Trademarks*